US006595089B1

(12) United States Patent
Stojanowski

(10) Patent No.: US 6,595,089 B1
(45) Date of Patent: Jul. 22, 2003

(54) RATCHETING ADJUSTABLE WRENCH

(76) Inventor: Thomas Stojanowski, 97 Delafield Pl., Staten Island, NY (US) 10310

( * ) Notice: Subject to any disclaimer, the term of this patent is extended or adjusted under 35 U.S.C. 154(b) by 0 days.

(21) Appl. No.: 10/139,163

(22) Filed: May 3, 2002

Related U.S. Application Data

(60) Provisional application No. 60/288,989, filed on May 7, 2001.

(51) Int. Cl.[7] ..... B25B 13/16
(52) U.S. Cl. ..... 81/165; 81/173
(58) Field of Search ..... 81/165, 158, 176, 81/155, 157, 173, 175, 358, 359, 133–135, 126, 111

(56) References Cited

U.S. PATENT DOCUMENTS 3,312,129 A * 4/1967 Nordgren ..... 81/165
3,349,654 A * 10/1967 Nordgren ..... 81/165
3,926,077 A * 12/1975 Nordgren ..... 81/165

* cited by examiner

*Primary Examiner*—D. S. Meislin
(74) *Attorney, Agent, or Firm*—Goldstein & Lavas, P.C.

(57) ABSTRACT

A ratcheting adjustable wrench, having a handle assembly and a head assembly. The handle assembly is pivotally attached to the head assembly. The head assembly includes a fixed jaw and a movable jaw which together may engage a nut. An opening, having an opening top and an opening bottom extends laterally through the fixed jaw. A shaft spans the opening from the opening top to the opening bottom. A rack having teeth is rigidly attached to the movable jaw. A worm gear is slidably mounted on the shaft, which is attached to the fixed jaw and engages the rack. The handle has a contact point which selectively urges the worm gear against the opening top of the fixed jaw to maintain the position of the fixed jaw with respect to the movable jaw to torque the nut. The handle is selectively pivotable with respect to the head assembly to release the contact point from the worm gear to allow the worm gear to slide on the shaft, thus allowing the movable jaw to move, and thus allowing the wrench to slip around the nut so that the handle can be repositioned to continue loosening or tightening the nut.

6 Claims, 2 Drawing Sheets

RATCHETING ADJUSTABLE WRENCH

CROSS REFERENCES AND RELATED SUBJECT MATTER

This application relates to subject matter contained in provisional patent application No. 60/288,989, filed in the United States Patent Office on May 7, 2001.

BACKGROUND OF THE INVENTION

The invention relates to a ratcheting adjustable wrench. In particular, the invention relates to an adjustable wrench which has a movable handle with respect to the jaw, which allows the wrench to engage and turn a nut, and then release the nut momentarily so that the handle can be repositioned to once again engage and turn the nut.

The use of a wrench to loosen or tighten a nut typically involves repeatedly removing the wrench from the nut so that the wrench can be repositioned prior to each partial turn of the nut. Such repositioning is time consuming, and has made ratcheting socket wrenches extremely popular, since they allow quick repetition of partial turns, without requiring that the wrench be removed from the nut. However, such socket wrenches require that a precisely sized socket be used. In most cases, the proper socket is not readily available. In many other cases the nut is located on a shaft, which does not permit a socket to extend over the nut. In either case, an adjustable wrench must be used.

Attempts have been made in the prior art to provide a ratcheting adjustable socket wrench. For example, U.S. Pat. Nos. 3,659,485 to Roth, 3,803,954 to Lenker, and 4,924,735 to Lenker, and 4,924,735 to Lee show several attempts to provide such a wrench.

My previous U.S. Pat. No. 5,297,459 discloses an open-end adjustable wrench which allows the user to easily loosen or tighten a nut without repeatedly removing and repositioning the wrench.

While these units may be suitable for the particular purpose employed, or for general use, they would not be as suitable for the purposes of the present invention as disclosed hereafter.

SUMMARY OF THE INVENTION

It is an object of the invention to produce an open-ended adjustable wrench which allows the user to repeatedly loosen or tighten a nut without repeatedly removing and repositioning the wrench. Accordingly, the wrench has a head which tightly engages a nut while turning the nut, but which pivots with respect the handle to simultaneously allow the jaw to slip around the nut and reposition the handle for another partial turn of the nut.

It is a further object of the invention to provide an open-ended adjustable wrench which is durable in construction, for a long useful life. Accordingly, the present invention employs a force plate, which extends between the handle and head, and distributes force from the handle to prevent undue strain on the worm gear shaft from the handle while the nut is under torque.

The invention is a ratcheting adjustable wrench, having a handle assembly and a head assembly. The handle assembly is pivotally attached to the head assembly. The head assembly includes a fixed jaw and a movable jaw which together may engage a nut. An opening, having an opening top and an opening bottom extends through the fixed jaw. A shaft spans the opening from the opening top to the opening bottom. A rack having teeth it rigidly attached to the movable jaw. A worm gear is slidably mounted on the shaft, which is attached to the fixed jaw and engages the rack. The handle has a contact point which selectively urges the worm gear against the opening top of the fixed jaw to maintain the position of the fixed jaw with respect to the movable jaw to torque the nut. A plate is mounted on the shaft for slidable movement thereon. The plate is interposed between the worm gear and contact point. The handle is selectively pivotable with respect to the head assembly to release the contact point from the worm gear to allow the worm gear to slide on the shaft, thus allowing the movable jaw to move, and thus allowing the wrench to slip around the nut so that the handle can be repositioned to continue loosening or tightening the nut.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
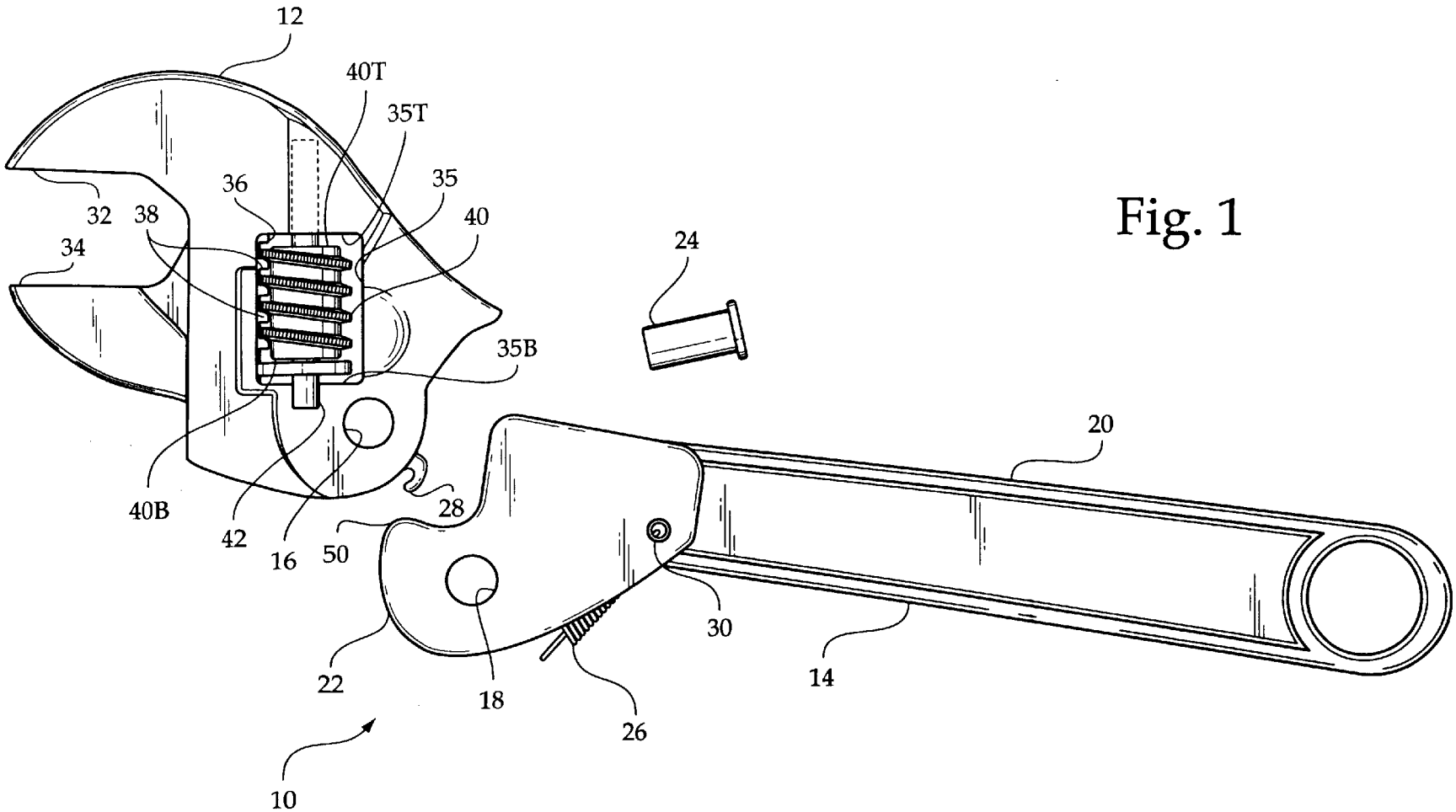
FIG. 1 is a side elevational view of the wrench according to the present invention, wherein the pivot pin connecting the head assembly and handle assembly has been removed, allowing said components to be separated.

FIG. 1 illustrates a wrench 10, having a head assembly 12 and a handle assembly 14. The handle assembly 14 includes a grip arm 20 and a pair of parallel panels 22 attached to the grip arm 20 on opposite sides thereof, with a recess therebetween. The head assembly 12 has a transverse head bore 16, and the handle assembly 14 has a transverse handle bore 18 which extends through both panels 22. A pivot pin 24 extends through both the transverse head bore 16 and the transverse handle bore 18 to connect the head assembly 12 and handle assembly 14 for pivotal movement of the head assembly 12 with respect to the handle assembly 14 in a manner which will be described hereinafter. Further, the wrench 10 is biased toward a torque position by a spring 26. The head assembly 12 has a spring catch 28, and the handle assembly 14 has a spring hole 30. The spring 26 extends between the spring catch 28 and spring hole 30 to bias the wrench in the torque position.

The head assembly 12 includes a jaw which is defined by a fixed jaw 32 and a movable jaw 34. A laterally extending opening 35, having a opening top 35T and an opening bottom 35B, extends in the fixed jaw 32. A rack 36, having a plurality of teeth 38 is rigidly attached to the movable jaw 34 and extends into the laterally extending opening 35. The fixed jaw 32 includes a worm gear 40 which engages the movable jaw 34 by engaging the rack 36. The worm gear has a worm gear top 40T and a worm gear bottom 40B. A shaft 42 extends into the opening top 35T and into the opening bottom 35B. The worm gear 40 is mounted on the shaft 42 such that it is capable of slidable movement on said shaft 42 toward the opening top 35T and opening bottom 35B. The worm gear 40 is configured so that as it is rotated axially, it moves the movable jaw 34 toward and away from the fixed jaw 32 to facilitate adjustment of the wrench 10 to accommodate a nut. In addition, the worm gear 40 remains engaged with the rack 36, so that when the worm gear 40 slides upward or downward on the shaft 42, it moves the movable jaw 34 with it to accomplish opening and closing of the jaw.

Figure 2:
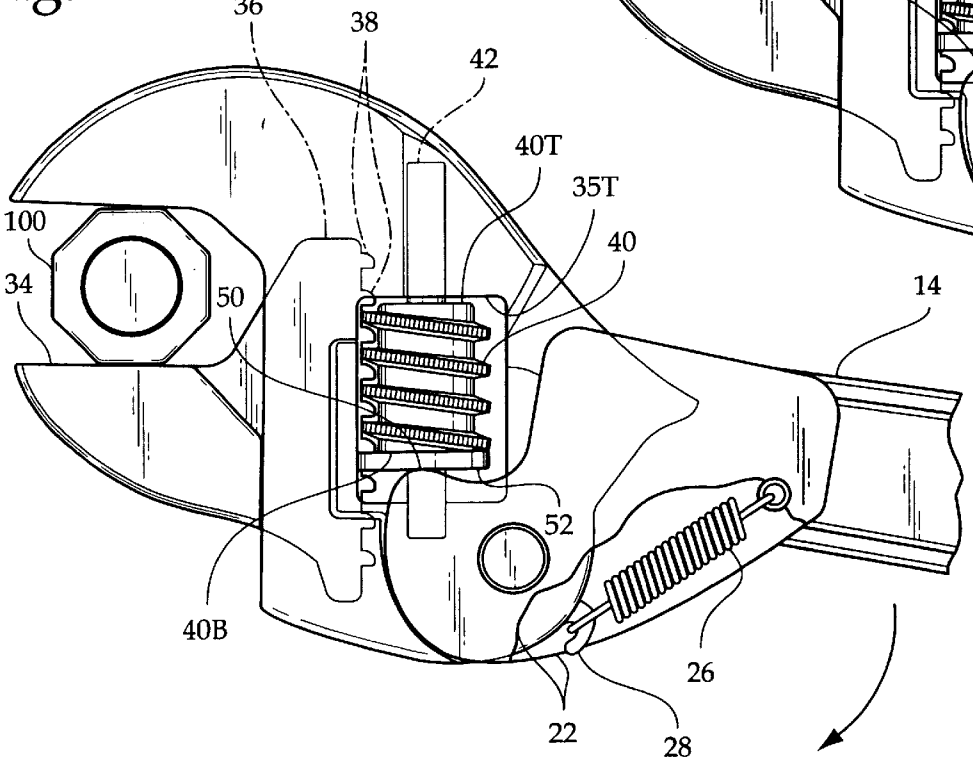
FIG. 2 is a side elevational view, detailing the head assembly, wherein the wrench is about to torque the nut.

The handle assembly 14 has a contact point 50 which selectively engages the worm gear 40 to selectively prevent, the movable jaw 34 from moving with respect to the fixed jaw 32, other than by axially rotating the worm gear 40. Referring to FIG. 2, during a torque stroke, in which the wrench 10 is used to loosen or tighten a nut 100, the worm gear top 40T is pressed tightly against the opening top 35T (the space therebetween is exaggerated in FIG. 2), such that substantially all force exerted by the handle assembly 14 in a first rotary direction (about the nut) is thereby transmitted to the nut 100, through the jaw, through the contact point 50. Accordingly a plate 52 is slidably mounted upon the shaft 42 between the worm gear bottom 40B and the contact point 50 to effectively distribute force from the handle assembly to the worm gear 40, and thus to the movable jaw 34. The plate 52 helps distribute the force so that it is exerted against the worm gear 40 in a direction substantially parallel to the shaft 42 before being transmitted to thee jaw 34 through the teeth 38 of the rack 36. Accordingly, shear to the shaft 42 is greatly reduced by the present invention—which might otherwise break the shaft 42 in time, as often occurs in prior art designs. In addition, the plate 52 provides a larger surface area than the worm gear bottom 40B, to prevent the contact points 50 from overshooting the worm gear bottom 40B, depending on the rotary position of the worm gear 40. The plate 52 also prevents the contact point 50 from "spinning" the worm gear 40 as it repeatedly comes into contact with the worm gear bottom 40B as the wrench is ratcheted. It should be clear that the contact points 50 contact the plate 52 on either lateral side of the fixed jaw 32, since the parallel plates 22 extend on either lateral side of the fixed jaw 32.

Figure 4:
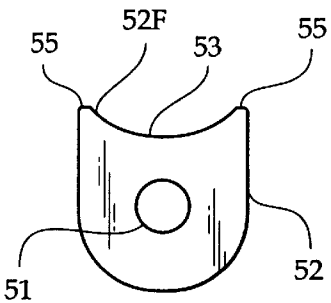
FIG. 4 is a top plan view of just the plate, removed from the wrench.

FIG. 4 illustrates just the plate 52. The plate has a plate bore 51, through which the shaft extends when mounted in place. The plate 52 has a front end 52F having a hollow 53 and a pair of side points 55 on either side of said hollow 53. When mounted on the shaft, the hollow 53 allows teeth of the rack to move freely therethrough, so that the rack does not interfere with the plate 52 sliding freely upward and downward along the rack. In addition, the side points 55 engage the fixed jaw 32 around the rack to prevent the plate 52 from spinning around the shaft when the contact points of the handle assembly come into contact with the plate 52.

Referring once again to FIG. 2, even when the wrench is not under torque, the spring 26 pulls against the spring catch 28 to urge the contact point 50 against the plate 52. The spring 26 exerts sufficient force so that the movable jaw 34 can be effectively adjusted around the nut.

Figure 3:
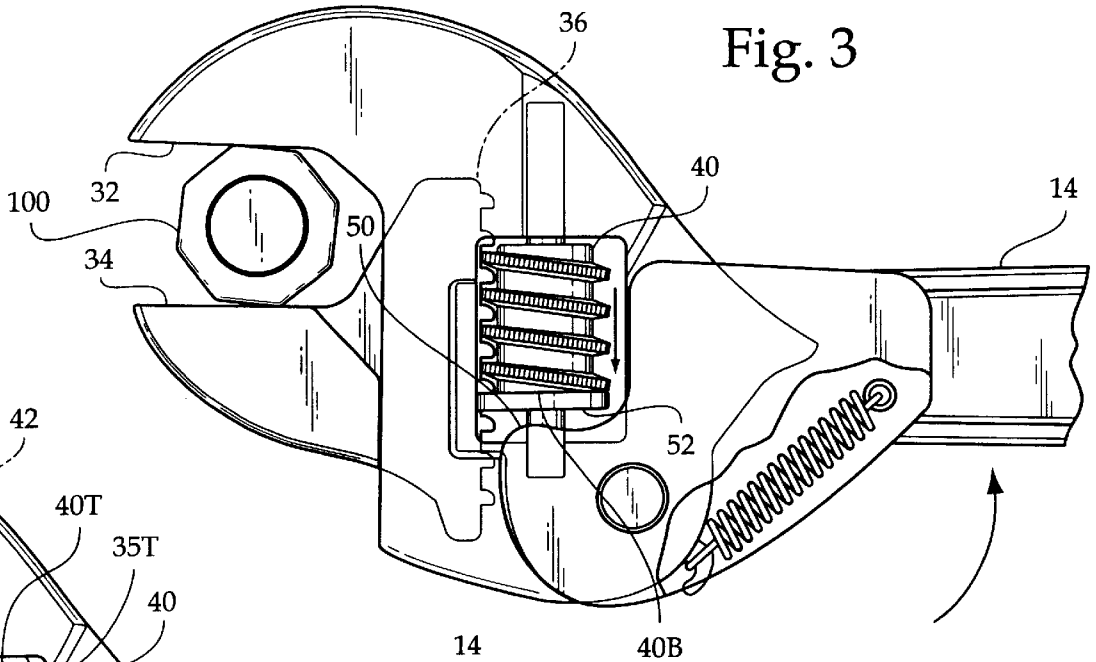
FIG. 3 is a side elevational view, similar to FIG. 2, except wherein the handle is being moved to a released position, wherein the handle is no longer exerting a force against the plate so that the movable jaw is allowed to move so that the jaw can slip around the nut and allow the handle to be repositioned for another torque stroke.

Referring to FIG. 3, a released position is indicated, which allows ratcheting of the wrench 10 to take place to reposition the wrench on the nut for further torqueing. Accordingly, when the handle assembly 14 is urged upward in a rotary direction opposite from the first rotary direction, as shown, substantially all force is exerted against the nut by the fixed jaw 32. Further, the contact point 50 no longer exerts pressure against the plate 52 and thus against the worm gear 40. Still further, space is provided beneath the worm gear bottom 40B (and the plate 52) for the worm gear 40 and plate 52 to slide downward on the shaft 42. Even further, the spring 26 is tensioned as the contact point is pulled away from the worm gear bottom 40B (and the plate 52). Thus, the movable jaw 34 linked to the rack 36 is capable of movement downward. Therefore, the jaw can slip around the nut 100 as shown, while the handle assembly 14 moves to a position where it is ready to torque the nut 100 once again. As the pressure against the handle by the user is relieved, the spring 26 returns the movable jaw 34 tightly against the fixed jaw. Accordingly, the handle assembly 14 is then urged downward by the spring 26 as in FIG. 2, the contact points 50 pressing against the plate 52, thus locking the movable jaw 34 against the nut 100, and allowing that same downward motion of the handle assembly 14 to torque the nut 100.

In conclusion, herein is presented an improved open-ended ratcheting wrench, which allows a user to tighten or loosen a nut without requiring that the user repeatedly remove the wrench from the nut in order to reposition the wrench. The wrench is configured for durability so as to have a long useful life. The invention is illustrated by example in the drawing figures. However it should be understood that numerous variations are possible while adhering to the inventive concepts. Such variations are contemplated as being a part of the present invention.

What is claimed is:

1. A ratcheting adjustable wrench, comprising:

a head assembly, having a fixed jaw and a movable jaw;

the fixed jaw having a laterally extending opening having an opening top and an opening bottom, a shaft extending between the opening top and opening bottom, a worm gear mounted on the shaft for slidable movement thereon, the worm gear having a worm gear top and a worm gear bottom;

the movable jaw having a rack having teeth, the teeth engaged with the worm gear, the relative longitudinal position of the rack with respect to the worm gear adjustable by axially rotating the worm gear;

a plate having a plate bore, the plate bore mounted on the shaft beneath the worm gear for slidable movement of the plate on said shaft, the plate has a hollow adjacent to the rack and a pair of side points on opposite sides of the hollow, the hollow allows the teeth of the rack to move freely through said hollow so that the plate can slide upward or downward on the shaft along the rack, the side points engage the fixed jaw adjacent to the rack to prevent the plate from spinning around the shaft; and a handle assembly, the handle assembly pivotally attached to the head assembly having a torque position and a release position, the handle assembly having a contact point near the worm gear, the contact point selectively engaging the plate to exert pressure upward against the worm gear bottom while in the torque position to hold the worm gear top against the opening top to substantially prevent the movable jaw from moving with respect to the fixed jaw other than by axially rotating the worm gear, the handle assembly also having a released position wherein the contact point does not engage the plate to exert pressure against the worm gear bottom and the worm gear is free to slide downward so that the movable jaw can move downward away from the fixed jaw.

2. The ratcheting adjustable wrench as recited in claim 1 wherein the head assembly has a transverse head bore, the handle assembly has a transverse handle bore, and a pivot pin extends through both the transverse head bore and the transverse handle bore to connect the head assembly and handle assembly for pivotal movement of the head assembly with respect to the handle assembly.

3. The ratcheting adjustable wrench as recited in claim 2, wherein the head assembly has a spring catch, the handle assembly has a spring hole, and further comprising a spring extending between the spring catch and spring hole, wherein the spring biases the wrench in the torque position wherein the contact point exerts upward pressure against the worm gear bottom to hold the movable jaw upward against the fixed jaw.

4. An adjustable wrench ratcheting method, for use in rotating a nut to perform one of tightening and loosening the nut, using a wrench having a head assembly having a fixed jaw and a movable jaw, the fixed jaw having a laterally extending opening having an opening top and an opening bottom, a shaft extending vertically from the opening top to the opening bottom, a worm gear mounted on the shaft for slidable movement thereon, the worm gear having a worm gear top and worm gear bottom, the movable jaw having a rack having teeth engaged with the worm gear, a plate having a plate bore and a hollow, the plate mounted on the shaft beneath the worm gear bottom with the shaft extending through the plate bore and the hollow adjacent to the rack, a handle assembly pivotally mounted to the fixed jaw, the handle assembly having a contact point, comprising the steps of:

(a) placing the nut between the fixed jaw and movable jaw by adjusting the movable jaw until the movable jaw is held tightly against the fixed jaw by axially rotating the worm gear and allowing the plate to slide along the shaft by allowing the teeth of the rack to pass freely through the hollow;

(b) turning the nut by torqueing the handle in a first rotary direction such that force from the handle presses the movable jaw tightly against the fixed jaw by pressing the worm gear tightly against the opening top by pushing upward against the worm gear bottom by the plate by the contact point pressing upward against the plate;

(c) slipping the wrench around the nut by releasing the handle in a rotary direction opposite from the first rotary direction by relieving pressure of the movable jaw against the fixed jaw by relieving pressure by the worm gear top against the opening top by relieving pressure by the contact point against the worm gear bottom; and (d) repeating steps (b) and (c) until the nut is suitably tightened or loosened.

5. The adjustable wrench method as recited in claim 4 wherein the head assembly has a transverse head bore, the handle assembly has a transverse handle bore, a pivot pin extends through both the transverse head bore and the transverse handle bore to connect the head assembly and handle assembly, and wherein the step of releasing the handle further comprises pivoting the head assembly with respect to the handle assembly about the pivot pin.

6. The adjustable wrench method as recited in claim 5, wherein the head assembly has a spring catch, the handle assembly has a spring hole, and further comprising a spring extending between the spring catch and spring hole, wherein the steps of holding the movable jaw tightly against the fixed jaw further comprises biasing the contact point against the plate, and wherein the step of relieving pressure by the contact point against the worm gear bottom further comprises tensioning the spring.

* * * * *